US005788072A

United States Patent [19]

Chen

[11] Patent Number: 5,788,072

[45] Date of Patent: Aug. 4, 1998

[54] TOOL BOX

[76] Inventor: Shwu Ruu Chen, 6F-6,186, Section 1, Wen Hsin Rd., Taichung, Taiwan

[21] Appl. No.: 965,761

[22] Filed: Nov. 7, 1997

[51] Int. Cl.[6] ..... B65D 1/22

[52] U.S. Cl. ..... 206/372; 220/500

[58] Field of Search ..... 206/234, 372, 206/373, 374, 375, 376, 377, 378; 220/503, 504, 505, 520, 521, 522, 523, 500

[56] References Cited

U.S. PATENT DOCUMENTS 4,340,140 7/1982 Wilcox et al. ..... 206/373

5,133,455 7/1992 Chow ..... 206/373

*Primary Examiner*—Jacob K. Ackun

[57] ABSTRACT

A tool box includes a body and a cover pivotally connected to the body which has a bottom with a peripheral wall extending therefrom which has two openings defined in two opposite sides thereof. The peripheral wall has two shoulder portions respectively formed in a front inner side and a rear inner side thereof, a separating ridge connecting between the two shoulder portions. The bottom has two slots defined therein and separated by the separating ridge. Two drawers are respectively and retractably received in the body via the two openings, each of the two drawers having a protrusion extending from an underside thereof so as to be movably received in the slot corresponding thereto. A plate member is disposed onto the two shoulder portions and has a plurality of cavities defined therein.

4 Claims, 3 Drawing Sheets

TOOL BOX

BACKGROUND OF THE INVENTION

1. Field of the Invention

The present invention relates to a tool box and, more particularly, to an improved tool box having two drawers retractably received in two sides of the tool box so as to conveniently receive small parts therein.

2. Brief Description of the Prior Art

Tool boxes are designed for receiving tools therein so that a user may carry the tool box with him/her so as to conveniently use the tools. The tool box generally has a body and a cover which is pivotally connected to a side of the body so as to securely cover on the body, the body having a plurality of recesses with different shapes so as to receive tools therein. In addition, there are many small parts frequently used during operations such as different types of bits, screws, nuts and sockets so that many tool boxes have at least one slot defined in the body to receive such small parts therein. However, tool boxes are often placed up-side-down or inclinedly, the small parts therefore could drop from the slots when opening the tool boxes. Furthermore, the tool boxes generally have a certain thickness when the cover is covered on the body and the above-mentioned recesses and slot only occupy a limited depth in the body. That is to say, there are a lot of areas in the body are useless.

The present invention intends to provide an improved tool box having two drawers respectively and retractably received in two sides of the tool box for receiving small parts so as to mitigate and/or obviate the above-mentioned problems.

SUMMARY OF THE INVENTION

In one aspect of the present invention, there is provided a tool box comprising a body and a cover pivotally connected thereto, two drawers and a plate member. The body has a bottom with a peripheral wall extending from a periphery defining the bottom, the peripheral wall having two shoulder portions respectively formed on a front inner side and a rear inner side thereof. A separating ridge extends from the bottom and is connected between the two shoulder portions. The peripheral wall has two openings respectively defined in two opposite sides thereof and the bottom has two slots defined therein separated by the separating ridge.

The two drawers are respectively and retractably received in the body via the openings and each have a protrusion extending from an underside thereof so as to be movably received in the slot corresponding thereto.

The plate member is removably disposed on the two shoulder portions and has a plurality of cavities defined in an upper surface thereof.

It is an object of the present invention to provide a tool box with two drawers retractably received in two opposite sides thereof.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
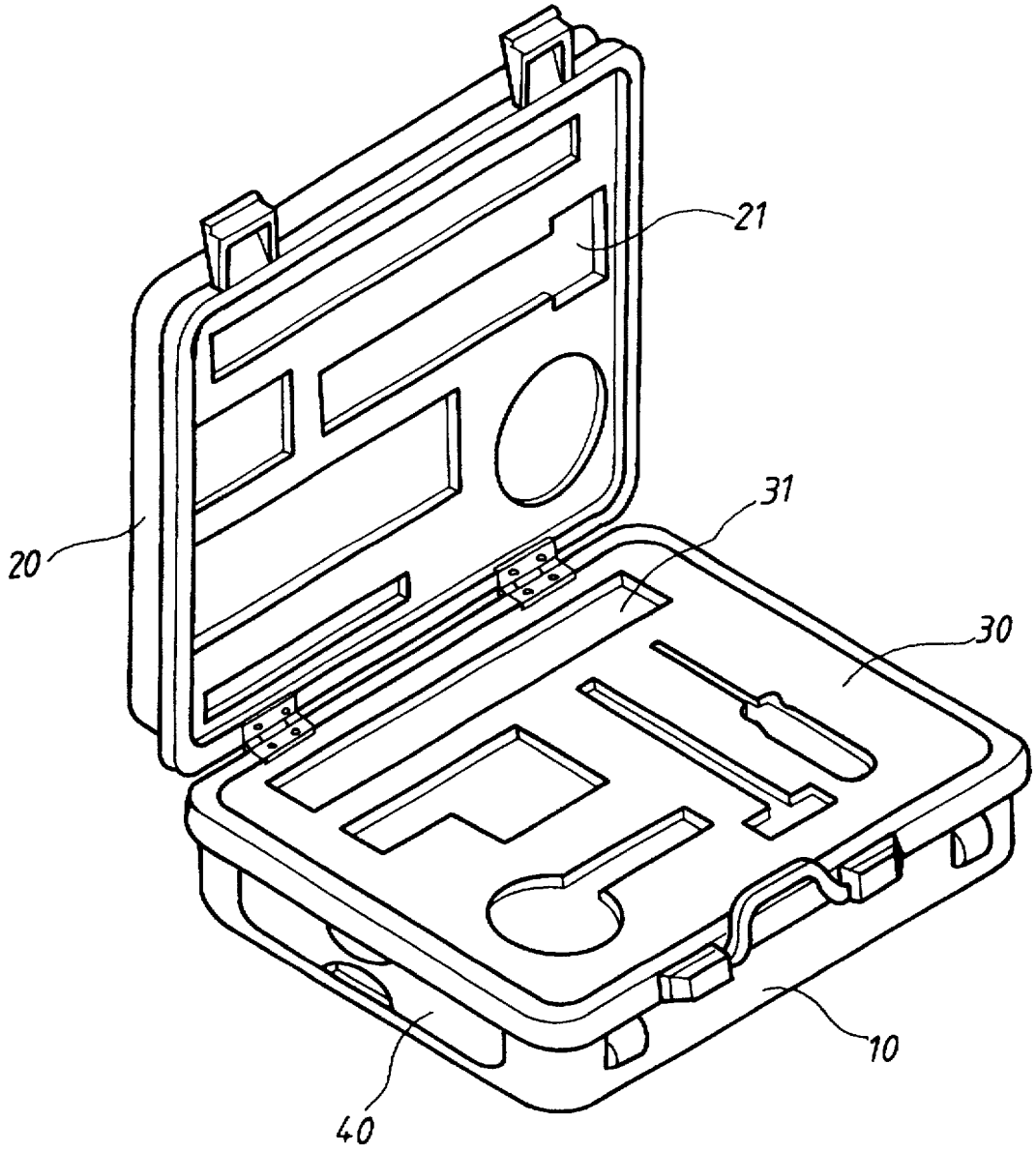
FIG. 1 is a perspective view of a tool box in accordance with the present invention.
Figure 2:
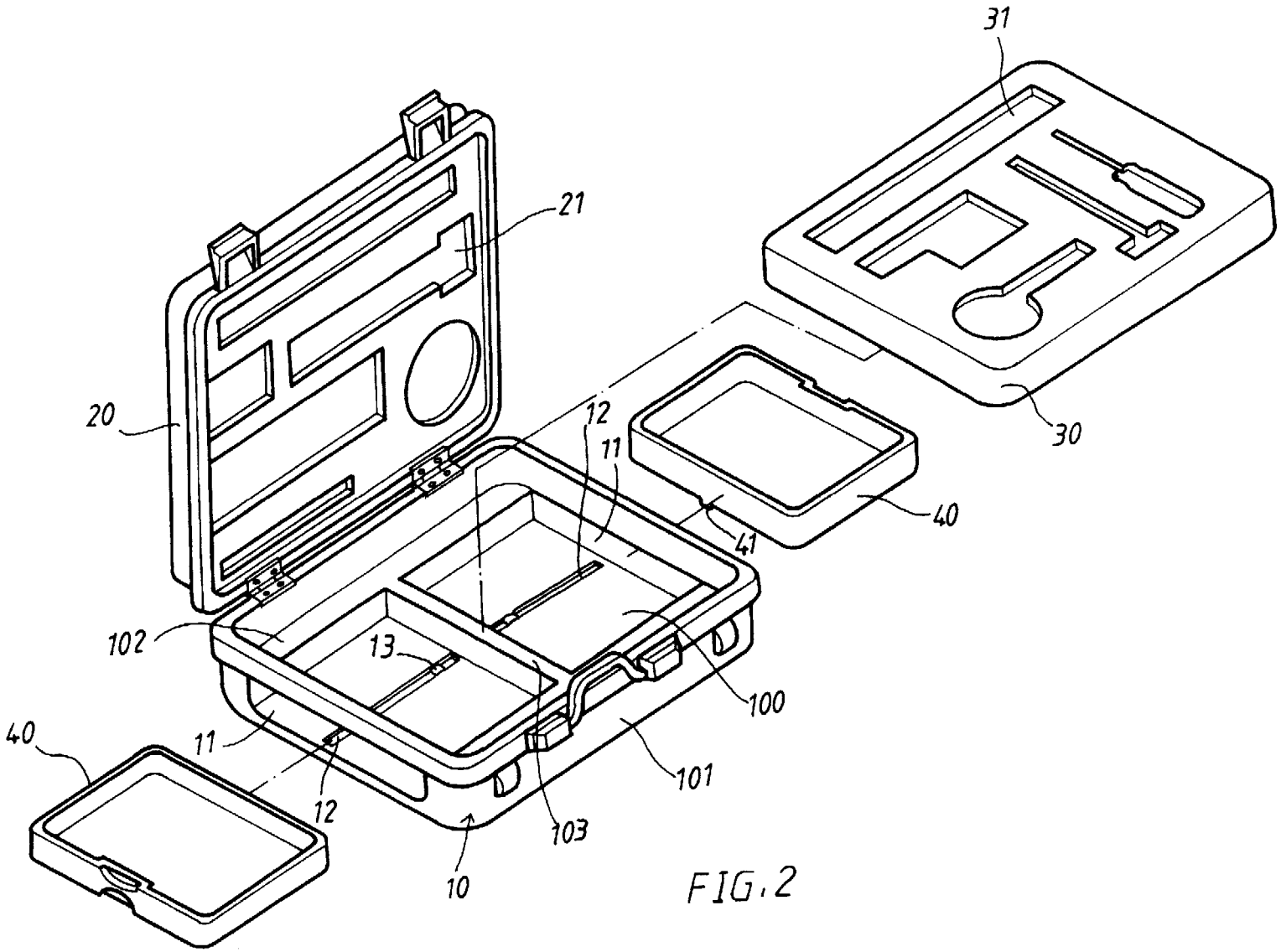
FIG. 2 is an exploded view of the tool box in accordance with the present invention.
Figure 3:
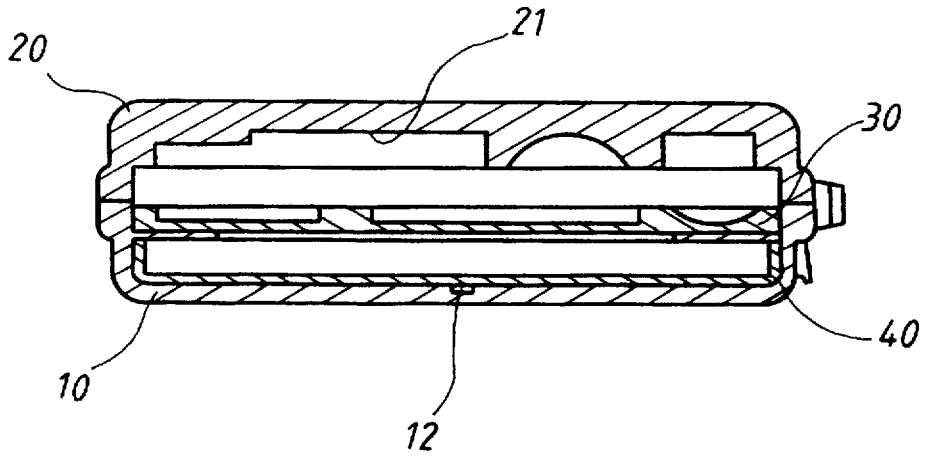
FIG. 3 is a side elevational view, partly in section, of the tool box.

Referring to the drawings and initially to FIGS. 1 and 2, a tool box in accordance with the present invention generally includes a body 10 and a cover 20 pivotally connected to a rear side of the body 10. The body 10 has a bottom 100 with a peripheral wall 101 extending from a periphery defining the bottom 100. The peripheral wall 101 has two shoulder portions 102 respectively formed on a front inner side and a rear inner side thereof. A separating ridge 103 extends from the bottom 100 and is connected between the two shoulder portions 102. The peripheral wall 101 has two openings 11 respectively defined in two opposite sides thereof and the bottom 100 has two slots 12 defined therein separated by the separating ridge 103. A boss 13 extends from a bottom defining each of the slots 12.

Two drawers 40 are respectively and retractably received in the body 10 via the openings 11. Each of the drawers 40 has a protrusion 41 extending from an underside thereof so as to be movably received in the slot 12 corresponding thereto and stopped by the boss 13 corresponding thereto.

A plate member 30 is removably disposed on the two shoulder portions 102 and has a plurality of cavities 31 defined in an upper surface thereof. The cover 20 has a plurality of second cavities 21 defined in an underside thereof and located corresponding to the cavities 31 in the plate member 30 so that when the cover 20 is covered to the body 10, tools (not shown) are received in the first and the second cavities 31, 21.

The tool box in accordance with the present invention has a feature of using a space thereof economically and small parts (not shown) received in the two drawers 40 will not drop even if the tool box is put up-side-down or inclinedly.

Although the invention has been explained in relation to its preferred embodiment, it is to be understood that many other possible modifications and variations can be made without departing from the spirit and scope of the invention as hereinafter claimed.

What is claimed is:

1. A tool box comprising:

a body and a cover pivotally connected to a rear side of said body, said body having a bottom with a peripheral wall extending from a periphery defining said bottom, said peripheral wall having two shoulder portions respectively formed on a front inner side and a rear inner side thereof, a separating ridge extending from said bottom and connected between said two shoulder portions, said peripheral wall having two openings respectively defined in two opposite sides thereof, said bottom having two slots defined therein and separated by said separating ridge;

two drawers respectively and retractably received in said body via said openings, each of said drawers having a protrusion extending from an underside thereof so as to be movably received in said slot corresponding thereto, and a plate member removably disposed on said two shoulder portions and having a plurality of cavities defined in an upper surface thereof.

2. The tool box as claimed in claim 1 wherein a boss extends from a bottom defining each of said slots.

3. The tool box as claimed in claim 1 wherein said cover has a plurality of second cavities defined in an underside thereof.

4. A tool box comprising:

a body and a cover pivotally connected to a rear side of said body, said cover having a plurality of cavities defined in an underside thereof, said body having a bottom with a peripheral wall extending from a periphery defining said bottom, said peripheral wall having two shoulder portions respectively formed on a front inner side and a rear inner side thereof, a separating ridge extending from said bottom and connected between said two shoulder portions, said peripheral wall having two openings respectively defined in two opposite sides thereof, said bottom having two slots defined therein and separated by said separating ridge, a boss extending from a bottom defining each of said slots;

two drawers respectively and retractably received in said body via said openings, each of said drawers having a protrusion extending from an underside thereof so as to be movably received in said slot corresponding thereto, and a plate member removably disposed on said two shoulder portions and having a plurality of second cavities defined in an upper surface thereof.

* * * * *